US009926103B2

(12) United States Patent
Xie

(10) Patent No.: US 9,926,103 B2
(45) Date of Patent: Mar. 27, 2018

(54) ASSEMBLED AND COMBINED PALLET

(71) Applicant: SUZHOU PICA ALUMINUM INDUSTRY LTD., Jiangsu (CN)

(72) Inventor: Xiaoyan Xie, Jiangsu (CN)

(73) Assignee: SUZHOU PICA ALUMINUM INDUSTRY LTD, Jiangsu (CN)

( * ) Notice: Subject to any disclaimer, the term of this patent is extended or adjusted under 35 U.S.C. 154(b) by 0 days.

(21) Appl. No.: 15/502,141

(22) PCT Filed: Dec. 19, 2014

(86) PCT No.: PCT/CN2014/094384

§ 371 (c)(1),
(2) Date: Feb. 6, 2017

(87) PCT Pub. No.: WO2016/019678

PCT Pub. Date: Feb. 11, 2016

(65) Prior Publication Data

US 2017/0225826 A1 Aug. 10, 2017

(30) Foreign Application Priority Data

Aug. 8, 2014 (CN) ..... 2014 2 0445457 U

(51) Int. Cl.
*B65D 19/38* (2006.01)
*B65D 19/00* (2006.01)

(52) U.S. Cl.
CPC ..... *B65D 19/38* (2013.01); *B65D 19/0095* (2013.01); *B65D 2519/00094* (2013.01); *B65D 2519/00273* (2013.01); *B65D 2519/00293* (2013.01); *B65D 2519/00323* (2013.01); *B65D 2519/00333* (2013.01);

(Continued)

(58) Field of Classification Search
CPC ..... B65D 2519/00024; B65D 2519/00273; B65D 2519/00293; B65D 2519/00323; B65D 19/0008; B65D 19/0055; B65D 19/00024
USPC ..... 108/57.17, 57.18, 57.19, 57.2, 57.21, 108/57.23, 57.24, 57.29, 57.32
See application file for complete search history.

(56) References Cited

U.S. PATENT DOCUMENTS 1,842,617 A * 1/1932 Lupton ..... B65D 19/0063 108/51.11
3,616,766 A * 11/1971 Weiss ..... B65D 19/0097 108/57.18

(Continued)

*Primary Examiner* — Jose V Chen
(74) *Attorney, Agent, or Firm* — Oliff PLC

(57) ABSTRACT

Assembled and combined pallet constitutes of supporting beams and skids wherein: the supporting beams are made of the hollow metal section bar and the supporting beams are equipped with the grooves along its length direction on the top; the skids are set with inserting blocks at the bottom in relation to the grooves on the top of the supporting beams and inserting blocks are inserted into the grooves along the length direction of the grooves; the supporting beam is set with a locating lever in relation to the inserting block of each skid, and the inserting block of each skid is set with a locking hole in relation to the locating lever and the locating level passes through the corresponding locking hole of the inserting block to lock the skid. The skid connection and supporting beam is reliable and the disassembly and assembly during the use is convenient and fast.

5 Claims, 4 Drawing Sheets

(52) U.S. Cl.
CPC ..... *B65D 2519/00338* (2013.01); *B65D 2519/00373* (2013.01); *B65D 2519/00567* (2013.01)

(56) References Cited

U.S. PATENT DOCUMENTS

| | | | | | |
|---|---|---|---|---|---|
| 4,145,976 | A * | 3/1979 | Svirklys | B65D 19/0095 | 108/56.1 |
| 4,485,744 | A * | 12/1984 | Umemura | B65D 19/0095 | 108/57.18 |
| 5,101,737 | A * | 4/1992 | Gomez | B65D 19/0095 | 108/57.1 |
| 5,367,960 | A * | 11/1994 | Schleicher | B65D 19/0095 | 108/56.1 |
| 5,417,167 | A * | 5/1995 | Sadr | B65D 19/0093 | 108/57.19 |
| 5,440,998 | A * | 8/1995 | Morgan, IV | B65D 19/0048 | 108/57.18 |
| 5,941,179 | A * | 8/1999 | Herring | B65D 19/0091 | 108/56.3 |
| 6,766,749 | B2 * | 7/2004 | Lacabanne | B65D 19/0085 | 108/56.3 |
| 6,938,558 | B1 * | 9/2005 | Peres | B65D 19/0095 | 108/56.3 |
| 7,987,798 | B2 * | 8/2011 | Kim | B65D 19/0095 | 108/51.11 |
| 2009/0101049 | A1 * | 4/2009 | Lee | B65D 19/0095 | 108/57.32 |
| 2011/0203491 | A1 * | 8/2011 | Poe | B65D 19/0095 | 108/42 |

* cited by examiner

ASSEMBLED AND COMBINED PALLET

TECHNICAL FIELD

The present invention relates to the pallet for the cargo shipment and storage, especially relates to an assembled pallet.

BACKGROUND OF INVENTION

During the cargo shipment and storage, a pallet is a necessary tool for the forklift handling.

In the prior art, the common pallet is divided into the wooden, plastic and aluminum alloy pallets in terms of the material. The wooden pallet is applied first, but its prone to be deformed, even be rotten after long term use. The plastic pallet overcomes the disadvantages of deformation and rotting of wooden pallet, but its prone to carry the bacteria after the long term use, so the sanitary level is not good.

The aluminum alloy pallet was invented in recent years and its sanitary level is good, so it could be used to transport the food, but the current domestic aluminum alloy pallet has the fixed structure, which includes many supporting beams arranged in parallel on the horizontal surface. Many skids are laid on the top of the supporting beams and the length direction of the skids is vertical to the length direction of the supporting beams and the skids and supporting beams are connected in a fixed way by welding or riveting, so they can't be disassembled and reinstalled. When the pallets are not used, the pallets could only be arranged and stacked in one piece during the transportation and storage, so they occupy a lot of space and the transportation and storage cost is high.

The foreign manufacturers tried to design a dismountable and assembled aluminum alloy pallet, i.e. dismountable and assembled pallet. Its structure is still very simple, as only the screws are set on the top of the skids and used to connected the skids and the supporting beams. This design could dismount the pallet when the pallet is not used and reinstall the pallet when its used. But the screws are prone to be loose during the service and once the screw falls off, the skids and the supporting beams are disconnected, so the connection reliability is not high; and many screws are used, so the dismount and installation are troublesome and take a lot of time and energy.

DISCLOSURE OF THE INVENTION

The purpose of present invention is to provide an assembled and combined pallet to solve the low connection reliability of skids and supporting beams in the prior art.

In order to achieve the said purpose, the present invention applies the technical solution: an assembled and combined pallet consists of many supporting beams arranged in parallel and several skids laid on the top of the supporting beams and the length direction of the skids is vertical to the length direction of the supporting beams; the supporting beams are made of the hollow metal section bar and the supporting beams are equipped with the grooves along its length direction on the top and the groove walls are set with the seizing edges; the skids are set with the inserting blocks at the bottom in relation to the grooves on the top of the supporting beams and the inserting blocks are inserted into the grooves along the length direction of the grooves and the inserting blocks cooperate with the seizing edges along the vertical direction; additionally, the supporting beam is set with a locating lever in relation to the inserting block of each skid and the locating lever is set on the supporting beam along the width direction of supporting beam, and the inserting block of each skid is set with a locking hole in relation to the locating lever and the locating level passes through the corresponding locking hole of the inserting block to lock the skid.

In above described technical solution, the locating level is set with the knurling and the locating level is connected through the engagement of knurling and the supporting beam or/and the inserting block.

In above described technical solution, the locating level is set with the external thread and the locating level is connected through the engagement of external thread and the supporting beam or/and the inserting block.

In above described technical solution, the skid is also made from the metal section bar and its set with two connection plates along its length direction and they are arranged in parallel in the width direction of skid. The connection plate is slotted in the walls of the grooves of the corresponding supporting beams and the connection plate is divided to the inserting connection part relative to the corresponding supporting beams and each skid is set with a inserting reinforcement block between the inserting connection parts along its width direction. The inserting reinforcement block and the inserting connection parts at two ends are fixed by riveting, so the inserting block consists of the inserting connection parts at two ends and the inserting reinforcement block in the middle.

In above described technical solution, the pallet consists of many bottom connection plates, which are laid on the bottom surface of supporting beams in parallel and the length direction of the bottom connection plates is vertical to the length direction of the supporting beams; the supporting beams are also equipped with the grooves along its length direction on the bottom surface and the groove walls are also set with the seizing edges; the bottom connection plates are set with the inserting blocks at the top in relation to the grooves on the bottom surface of the supporting beams and the inserting blocks are inserted into the grooves along the length direction of the grooves and the inserting blocks cooperate with the seizing edges along the vertical direction; additionally, the supporting beam is set with a locating lever in relation to the inserting block of each bottom connection plate and the locating lever is set on the supporting beam along the width direction of supporting beam, and the inserting block of each bottom connection plate is set with a locking hole in relation to the locating lever and the locating level passes through the corresponding locking hole of the inserting block to lock the bottom connection plate.

In comparison with prior art, the present invention has the following advantages:

1. As the present invention applies the cooperation of the inserting block on the skid and the groove of the supporting beam and applies the locating lever to lock the skid, even one locating lever is dropped off during the use, the skid will not be disconnected from the supporting beam and the pallet could still be used, so the connection reliability of the skid and supporting beam in the present invention is good.
2. As the present invention applies the cooperation of the inserting block on the skid and the groove of the supporting beam and applies the locating lever to lock the skid, its only necessary to remove the locating lever to remove the inserting block of the skid from the groove during the disassembly to dismantle the pallet; and its only necessary to insert the inserting blocks of the skids into the grooves of the supporting beams and insert the locating level during the installation to install the pallet, so the disassembly and the assembly is convenient and fast.

In the above figures, 1. supporting beam; 11. groove; 111. seizing edge; 2. skid; 21. inserting block; 211. locking hole; 212. inserting connection part; 213. inserting reinforcement block; 3. locating lever; 31. knurling; 4. connection plate; 5. bottom connection plate; 51. inserting block; 511. locking hole.

SPECIFIC EMBODIMENT

With reference to the accompanying drawings and embodiment, the present invention will be described in detail.

Figure 1:
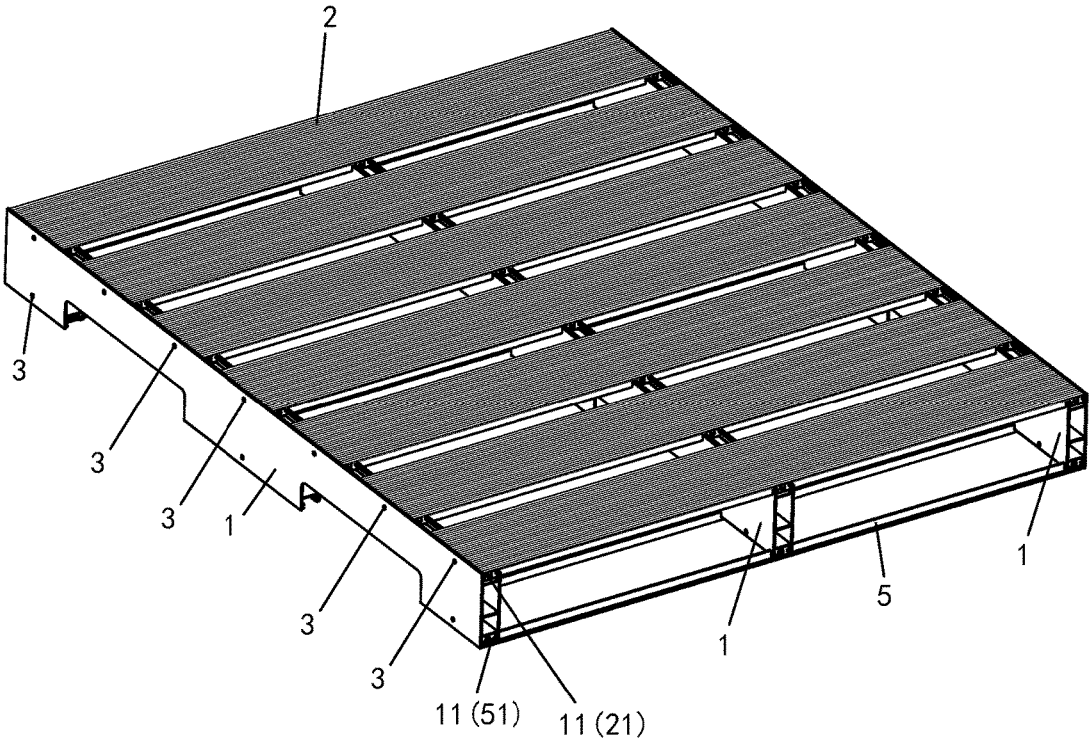
FIG. 1 is the perspective schematic view of embodiment of present invention.
Figure 2:
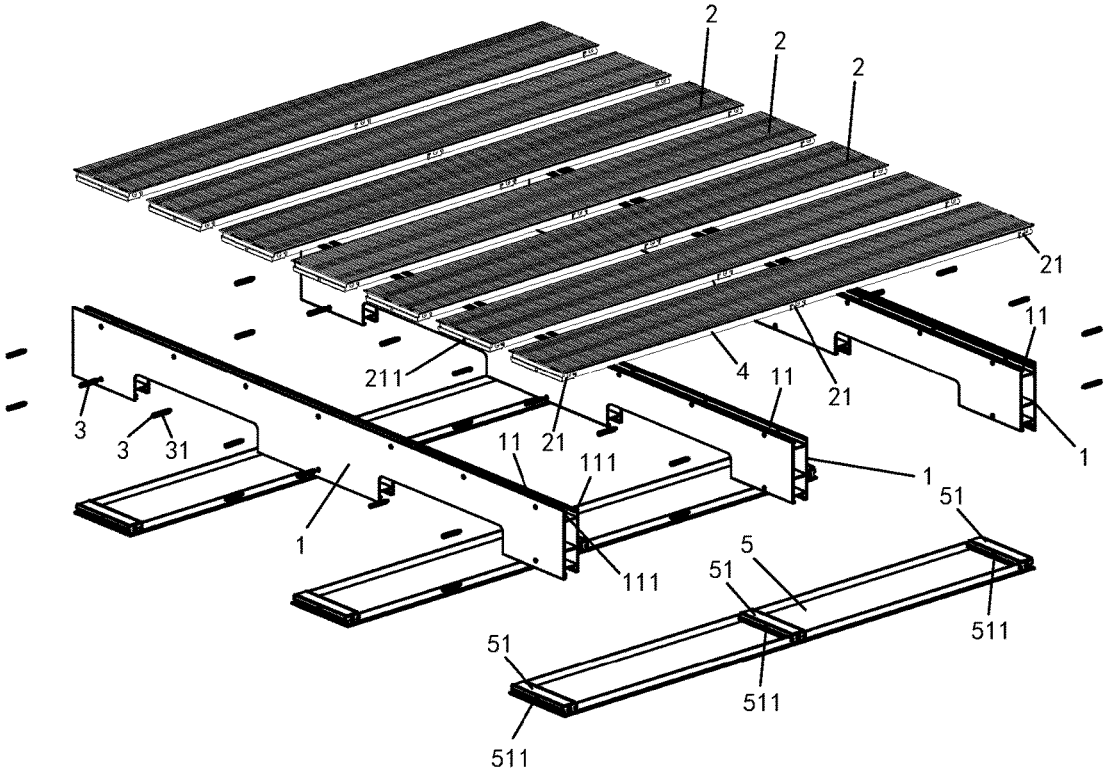
FIG. 2 is the perspective schematic view of decomposition of embodiment of present invention.
Figure 3:
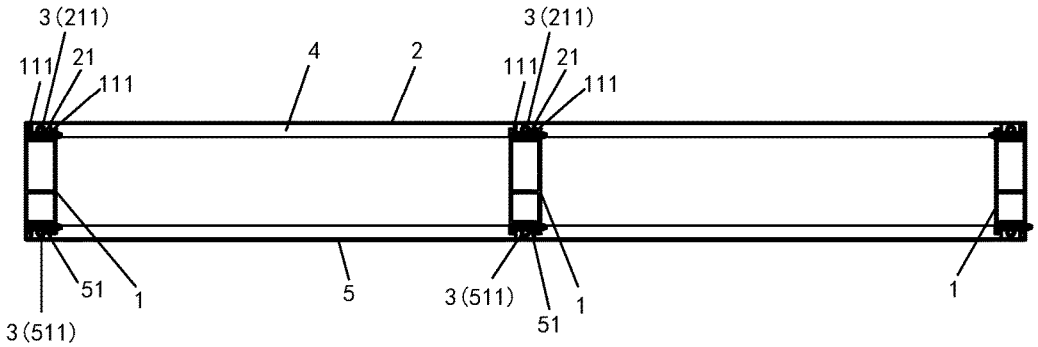
FIG. 3 is the side elevation of embodiment of present invention.

Embodiment: as shown in FIG. 1~7:

An assembled and combined pallet as shown in FIG. 1 consists of many supporting beams 1 arranged in parallel and several skids 2 laid on the top of the supporting beams 1 and the length direction of the skids 2 is vertical to the length direction of the supporting beams 1; As shown in FIG. 1, the quantity of the supporting beams 1 in the example is 3 and the quantity of the skids 2 is 7.

Refer to FIG. 1-3 and FIG. 6-7, the supporting beams 1 are made of the hollow metal section bar, or the aluminum or aluminum alloy profile is preferred. The supporting beams 1 are equipped with the grooves 11 along its length direction on the top and the groove walls of the grooves 11 are set with the seizing edges 111. The skids 2 are set with the inserting blocks 21 at the bottom in relation to the grooves 11 on the top of the supporting beams 1 and the inserting blocks 21 are inserted into the grooves 11 along the length direction of the grooves 11 and the inserting blocks 21 cooperate with the seizing edges 111 along the vertical direction.

Refer to FIG. 1-3 and FIG. 6-7, the supporting beam 1 is set with a locating lever 3 in relation to the inserting block 21 of each skid 2 and the locating lever 3 is set on the supporting beam along the width direction of supporting beam 1, and the inserting block 21 of each skid 2 is set with a locking hole 211 in relation to the locating lever 3 and the locating level 3 passes through the corresponding locking hole 211 of the inserting block 21 to lock the skid 2. Additionally, the locating level 3 is set with the knurling 31 and the locating level 3 is connected through the engagement of knurling 31 and the supporting beam 1 and the inserting block 21.

Figure 4:
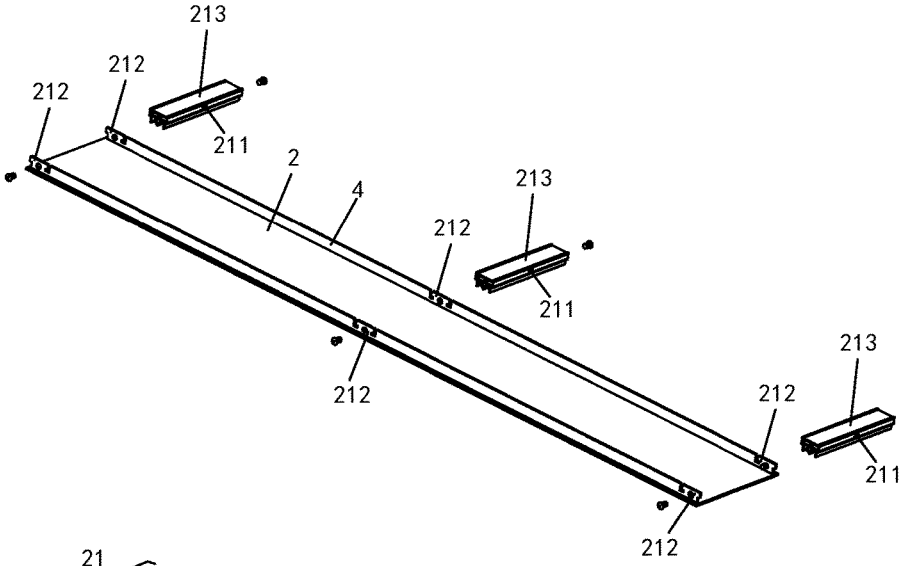
FIG. 4 is the perspective schematic view of decomposition of skid of embodiment of present invention.
Figure 5:
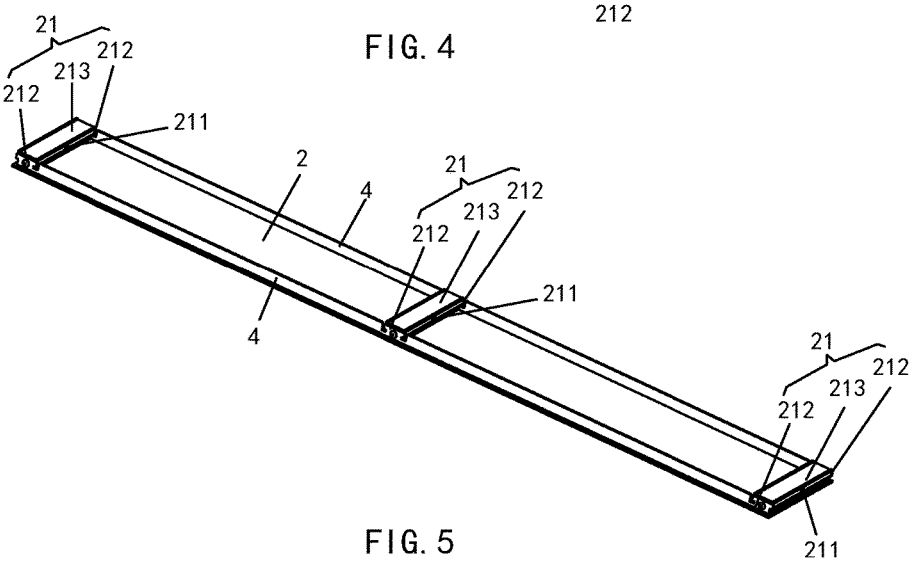
FIG. 5 is the perspective schematic view of skid with bottom facing upward of embodiment of present invention.
Figure 6:
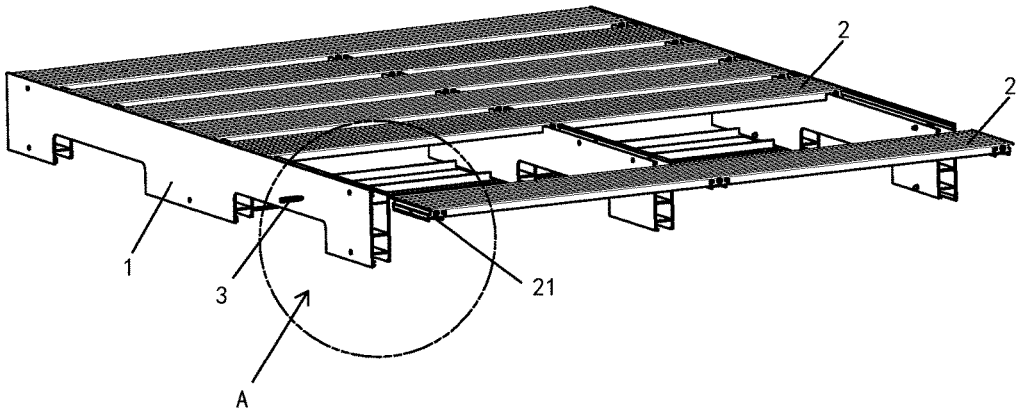
FIG. 6 is the perspective schematic view of embodiment of present invention with one skid removed.
Figure 7:
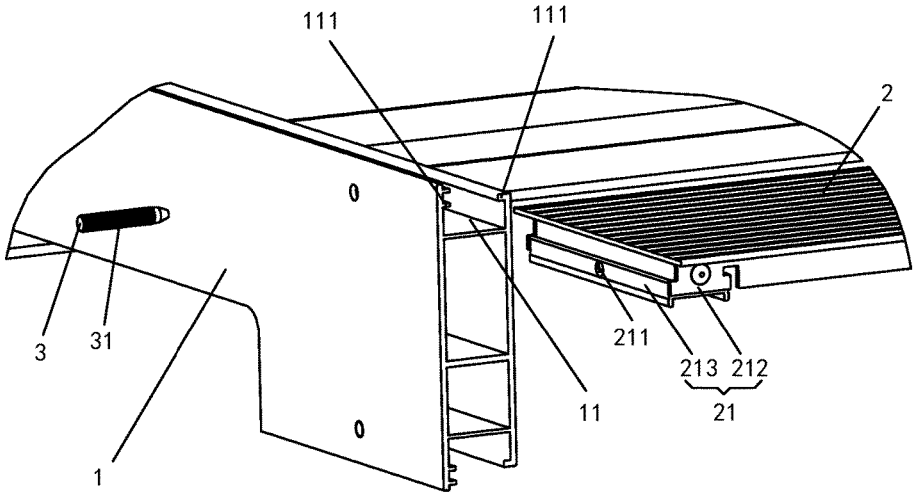
FIG. 7 is the enlarged view of area A in FIG. 6.

Refer to FIGS. 4 and 5, the skid 2 could be made of the metal section bar such as the aluminum or aluminum alloy profile. The skid is set with two connection plates 4 along its length direction and the two connection plates 4 are arranged in parallel in the width direction of skid 2. The connection plate 4 is slotted in the walls of the grooves 11 of the corresponding supporting beams 1 and the connection plate 4 is divided to the inserting connection part 212 relative to the groove 11 of corresponding supporting beams 1 and each skid 2 is set with a inserting reinforcement block 213 between the inserting connection parts 212 along its width direction. The inserting reinforcement block 213 and the inserting connection parts 212 at two ends are fixed by riveting, so the inserting block 21 consists of the inserting connection parts 212 at two ends and the inserting reinforcement block 213 in the middle. The inserting reinforcement block 213 could be made of the plastic.

Refer to FIG. 1-3 and FIG. 6-7, the pallet also consists of many bottom connection plates 5. The quantity in the Figure is 3. The bottom connection plates 5 are laid on the bottom surface of supporting beams 1 in parallel and the length direction of the bottom connection plates 5 is vertical to the length direction of the supporting beams 1. The supporting beams 1 are also equipped with the grooves 11 along its length direction on the bottom surface and the groove walls of the groove 11 are also set with the seizing edges 111; the bottom connection plates 5 are set with the inserting blocks 51 at the top in relation to the grooves 11 on the bottom surface of the supporting beams 1 and the inserting blocks 51 are inserted into the grooves 11 along the length direction of the grooves 11 and the inserting blocks 51 cooperate with the seizing edges 111 along the vertical direction. Additionally, the supporting beam 1 is set with a locating lever 3 in relation to the inserting block 51 of each bottom connection plate 5 and the locating lever 3 is set on the supporting beam 1 along the width direction of supporting beam 1, and the inserting block 51 of each bottom connection plate 5 is set with a locking hole 511 in relation to the locating lever 3 and the locating level 3 passes through the corresponding locking hole 511 of the inserting block 51 to lock the bottom connection plate 5.

During the use of embodiment, even one locating lever is dropped off during the use, the skid 2 and the bottom connection plate 5 will not be disconnected from the supporting beam 1 and the pallet could still be used, so the connection reliability of the pallet of the present embodiment is good. Its only necessary to remove the locating lever 3 to remove the inserting block 21 of the skid 2 from the groove 11 during the disassembly to dismantle the pallet; and its only necessary to insert the inserting blocks 21 of the skids 2 into the grooves of the supporting beams 1 and insert the locating level 3 during the installation to install the pallet, so the disassembly and the assembly is convenient and fast.

The embodiment is just for illustration and in practical application, the skid 2 and the bottom connection plate 5 could be made of the other materials, such fiberglass reinforced plastics. The locating function of the locating level 2 in the supporting beam could not only be realized by the knurling 31, as it could be realized by other demountable means, for example, the locating level 3 could be set with the external threads and the locating level 3 could be connected with the threads of supporting beam 1 or/and inserting block 21 through the external threads.

It should be noted that the above described embodiments are only for illustration of technical concept and characteristics of present invention with purpose of making those skilled in the art understand the present invention, and thus these embodiments shall not limit the protection range of present invention. The equivalent changes or modifications according to spiritual essence of present invention shall fall in the protection scope of present invention.

The invention claimed is:

1. An assembled and combined pallet, comprising:

several supporting beams arranged in parallel and comprising a hollow metal section bar, the supporting beams including grooves along a length direction on a top of the supporting beams, the grooves comprising groove walls set with seizing edges, the seizing edges extending into the grooves from the groove walls; and several skids laid on the top of the supporting beams where the length direction of the skids is vertical to the length direction of the supporting beams, the skids including inserting blocks inserted into the grooves along the length direction of the grooves, a portion of the inserting blocks being positioned between the seizing edges in the vertical direction, wherein the skids are set with the inserting blocks at a bottom in relation to the grooves on the top of the supporting beams, the supporting beams are set with a locating lever in relation to the inserting block of each skid, the locating lever is set on the supporting beam along a width direction of the supporting beam, the inserting block of each skid is set with a locking hole in relation to the locating lever, and the locating lever passes through the corresponding locking hole of the inserting block to lock the skid.

2. The assembled and combined pallet as claimed in claim 1, wherein the locating lever is set with a knurling and the locating lever is connected through the engagement of the knurling and the supporting beam or/and the inserting block.

3. The assembled and combined pallet as claimed in claim 1, wherein the locating lever is set with the external thread and the locating lever is connected through the engagement of the external thread and the supporting beam or/and the inserting block.

4. The assembled and combined pallet as claimed in claim 1, wherein the skid is comprises a metal section bar and is set with two connection plates along a length direction of the skid and the two connection plates are arranged in parallel in a width direction of skid; each of the connection plates is slotted in the walls of the grooves of the corresponding supporting beams, each of the inserting blocks comprises two inserting connection parts with one inserting connection part positioned at each end and an inserting reinforcement block positioned between the inserting connection parts, the inserting reinforcement block and the inserting connection parts being fixed by riveting, each of the connection plates is divided to the inserting connection part relative to a corresponding groove of the corresponding supporting beams, and each of the skids is set with the inserting reinforcement block between the inserting connection parts along its width direction.

5. The assembled and combined pallet as claimed in claim 1, wherein the pallet comprises bottom connection plates, the bottom connection plates are laid on a bottom surface of the supporting beams in parallel and a length direction of the bottom connection plates is vertical to the length direction of the supporting beams, the bottom connection plates including second inserting blocks, the supporting beams further comprising the grooves along the length direction of the supporting beams;

the bottom connection plates are set with the second inserting blocks at a top in relation to the grooves on the bottom surface of the supporting beams, the supporting beams are set with a second locating lever in relation to the second inserting blocks of each bottom connection, the second locating lever is set on the supporting beam along the width direction of supporting beam, and the second inserting block of each bottom connection plate is set with a second locking hole in relation to the second locating lever and the second locating lever passes through the corresponding second locking hole of the second inserting block to lock the bottom connection plate.

* * * * *